US007027746B2

(12) United States Patent
Suzuki et al.

(10) Patent No.: US 7,027,746 B2
(45) Date of Patent: Apr. 11, 2006

(54) IMAGE FORMING APPARATUS INCLUDING A PLURALITY OF DEVELOPING DEVICES WITH A TONER DENSITY DETECTING FEATURE

(75) Inventors: Hideaki Suzuki, Toride (JP); Yusuke Ishida, Toride (JP); Kazushige Nishiyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/944,777

(22) Filed: Sep. 21, 2004

(65) Prior Publication Data

US 2005/0100355 A1 May 12, 2005

(30) Foreign Application Priority Data

Sep. 22, 2003 (JP) ..... 2003-330031

(51) Int. Cl.
*G03G 15/08* (2006.01)

(52) U.S. Cl. ..... 399/27; 399/227

(58) Field of Classification Search ..... 399/27, 399/227

See application file for complete search history.

(56) References Cited

U.S. PATENT DOCUMENTS

| | | | | |
|---|---|---|---|---|
| 4,743,938 | A | 5/1988 | Ohno | 355/3 DD |
| 5,424,812 | A | 6/1995 | Kemmochi et al. | 355/251 |
| 5,655,185 | A | 8/1997 | Hori et al. | 399/138 |
| 6,349,183 | B1 | 2/2002 | Nagamine et al. | 399/27 |
| 2004/0179856 | A1 | 9/2004 | Suzuki | 399/27 |
| 2004/0223776 | A1 | 11/2004 | Ishida | 399/49 |

FOREIGN PATENT DOCUMENTS

| | | | |
|---|---|---|---|
| JP | 5-313495 | | 11/1993 |
| JP | 10-333416 | | 12/1998 |
| JP | 2001034019 | A * | 2/2001 |
| JP | 2001066844 | A * | 3/2001 |

OTHER PUBLICATIONS

Computer translation of cited reference JP05-313495a.*
Patent Abstracts of Japan, Publication No. 5-313495, Nov. 26, 1993.

* cited by examiner

*Primary Examiner*—Quana Grainger
(74) *Attorney, Agent, or Firm*—Fitzpatrick, Cella, Harper & Scinto

(57) ABSTRACT

An image forming apparatus includes an image bearing member for bearing an electrostatic latent image; a developing device for developing the latent image on the image bearing member with a developer including toner and carrier particles at a developing position, the developing device including a developer carrying member for carrying the developer, a plurality of developing devices containing toner particles which have colors different from each other, and a moving mechanism for carrying the developing devices to move a selected one of the developing devices to the developing position. The apparatus further includes a density detector for detecting a toner density on the developer carrying member the devices located at a position different from the developing position; a controller, responsive to an output of the density detector, for controlling toner contents in the developing devices. When the density operation in an operation mode, in which only one of the developing devices is used, the controller effects the density detecting operation after the developer carrying member is rotated through a predetermined period of time, for the developing device which comes to a detecting position by way of the developing position.

5 Claims, 8 Drawing Sheets

IMAGE FORMING APPARATUS INCLUDING A PLURALITY OF DEVELOPING DEVICES WITH A TONER DENSITY DETECTING FEATURE

FIELD OF THE INVENTION AND RELATED ART

The present invention relates to an image forming apparatus such as a copying machine, a laser beam printer, etc., that uses one of the electrophotographic processes.

More specifically, the present invention relates to an image forming apparatus comprising: a plurality of developing devices having a developer bearing member for bearing and conveying developer to the development location at which an electrostatic image formed on the image bearing member is developed; a moving means capable of holding the plurality of developing devices and moving a specific developing device among the plurality of developing devices to the development location; and a toner concentration detecting means for detecting the toner concentration of the developer borne on the developer bearing member of the developing device located at the developer concentration detection location different from the development location.

In the field of an electrophotographic image forming apparatus, in particular, an image forming apparatus for forming a color image, it is common practice to employ a two-component development system, which uses, as developer, a mixture of nonmagnetic toner and magnetic carrier. In terms of image quality stability and apparatus durability, a two-component development system is superior to other development systems which are currently proposed. However, only toner is consumed by image formation, and therefore, the toner concentration (weight ratio of toner relative to overall weight of developer) must be kept within a proper range, by supplying the two-component developer in each developing device with toner as necessary. Keeping the toner concentration within a proper range is one of the extremely important requirements for keeping a developing device stable in image quality. Therefore, various methods for controlling developer in toner concentration have been proposed, and some of them have been put to practical use.

For example, an optical detection system, an inductance detection system, a patch detection system, a video count system, etc., have been proposed as toner concentration detection systems, and some of them have been put to practical use.

Among the aforementioned various methods or systems for detecting toner concentration, a patch detection system has been widely used because of its cost advantage. More specifically, according to a patch detection system, a referential toner image is formed on an electrophotographic photosensitive member as an image bearing member. This toner image is illuminated by a light source positioned opposite to the image bearing peripheral surface of the image bearing member, and the density of the toner image is read by a sensor which also is positioned opposite to the image bearing peripheral surface of the image bearing member to intercept the light reflected by the toner image. Then, a developing device is supplied with toner based on the value of the output of the sensor. Thus, it is unnecessary to provide each developing device with a sensor, making this method advantageous in terms of cost.

However, since a patch detection system controls toner concentration based on the density of the patch (toner image) formed on a photosensitive member, it has the following problem. That is, the image density of a patch is affected not only by the toner concentration, but also, by the developer properties, which change due to changes in ambience, length of usage or storage, etc. Therefore, it is virtually impossible to very precisely control the toner concentration based on the image density of a patch alone. In other words, if the toner concentration is controlled based on a patch detection system in accordance with the prior art, it is possible that toner concentration will become excessively high or excessively low.

As for the solution to the above described problem, all that is necessary is to provide a developing device with a toner concentration sensor (optical sensor, inductance sensor, etc.) capable of directly detecting the toner concentration in a developing device. However, such an arrangement is disadvantageous in terms of cost, in particular, in the case of such an image forming apparatus as a full-color image forming apparatus having a plurality of developing devices, because the number of the sensors for detecting the toner concentration must match the number of the developing devices.

As for the solution to this problem, the following methods have been proposed, and some of them have been put to practical use (Japanese Laid-open Patent Application 5-313495). According to these methods, the toner concentration of the two-component developer in a given developing device is detected by detecting the amount of the light reflected by the peripheral surface of a developer bearing member, which is bearing and conveying the two-component developer in the developing device (amount of light reflected by layer of developer borne on developer bearing surface of developer bearing member), by a single optical sensor positioned outside the developing device.

These methods may be said to be very excellent toner concentration detection methods for an image forming apparatus (for example, an image forming apparatus comprising a rotary capable of holding a plurality of developing devices and capable of rotating so that a given developing device among a plurality of developing devices it holds, is placed in a position in which the device opposes the peripheral surface of photosensitive member) comprising: a plurality of developing devices having a developer bearing member for bearing and conveying developer, which is a mixture of toner and carrier, to the development location at which an electrostatic image formed on the image bearing member is developed; a developing device moving means capable of holding the plurality of developing devices and moving a specific developing device among the plurality of developing devices to the development location; and a toner concentration sensor for detecting the toner concentration of the developer borne on the developer bearing member of the developing device and located at the toner concentration detection location different from the development location, because, as a given developing device is moved to the development position, another developer bearing member of the developing device is automatically moved into a position in which it faces the toner concentration sensor, making it possible to directly detect the toner concentration in this developing device. In other words, any of these toner concentration detection methods is simple in structural arrangement, low in cost, and yet, is very accurate. Therefore, they are excellent toner concentration methods for such an image forming apparatus as the one described above.

However, even the above-described toner concentration detection methods have been problematic in that the amount of the light reflected by the developer bearing surface of a developer developing member was affected by the image ratio of an image formed immediately prior to the toner concentration detection, or by the difference among image formation modes; in other words, even if the actual toner concentration of the developer in a developing device at the first point in time at which the toner concentration was detected was virtually the same as the actual toner concentration of the developer detected at the second point in time at which the toner concentration was detected, the toner concentration detected at the second point in time sometimes became very different from that at the first point.

For example, when an image formed immediately before the toner concentration detection is detected is solidly dark, the toner concentration of the developer in a developing device is sometimes determined to be excessively lower than when an image formed immediately before the toner concentration detection is full of white areas, because when a solidly dark image is formed, the amount by which the toner in the developer is consumed is substantially greater than when an image full of white areas is formed.

Further, when a full-color image forming apparatus of a rotary type is continuously operated in the monochromatic mode before the toner concentration is detected, the developing devices other than the one used for the continuous monochromatic image forming operation are not used for the development at all, and are simply moved past the development position in which they oppose the photosensitive member, as the rotary is moved back into its home position. Thus, when they are moved past the development position in which they oppose the photosensitive drum, only the toner in the developer layer on the peripheral surface of each of the development sleeves in the developing devices which are not being used for the development, is transferred little-by-little onto the photosensitive member, as the rotary is repeatedly moved back into the home position. Therefore, if the toner concentration is detected immediately after this phenomenon has occurred, the toner concentration in the developing device is sometimes determined to be lower than the actual toner concentration in the developing device.

SUMMARY OF THE INVENTION

Thus, the primary object of the present invention is to provide an image forming apparatus capable of reliably detecting the toner concentration of developer, regardless of the density of the image formed immediately before the toner concentration detection, and image formation modes.

According to an aspect of the present invention, there is provided an image forming apparatus comprising an image bearing member for bearing an electrostatic latent image; developing means for developing the electrostatic latent image on said image bearing member with a developer including toner and carrier particles at a developing position, said developing means including, a developer carrying member for carrying the developer, a plurality of developing devices containing toner particles which have colors different from each other, and moving means for carrying said developing devices to move a slected one of said developing devices to said developing position, said apparatus further comprising density detecting means for detecting a toner density on said developer carrying member of a developing devices located at a position in different from said developing position; control means, responsive to an output of said density detecting means, for controlling toner contents in said developing devices, wherein when said density detecting means effects its density detecting operation in an operation mode, in which only one of said developing devices is used, said control means effects said density detecting operation after said developer carrying member is rotated through a predetermined period of time, for the developing device which comes to the detecting a position by way of the developing position.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

[Embodiment 1]

1) Example of Image Forming Apparatus

Figure 1:
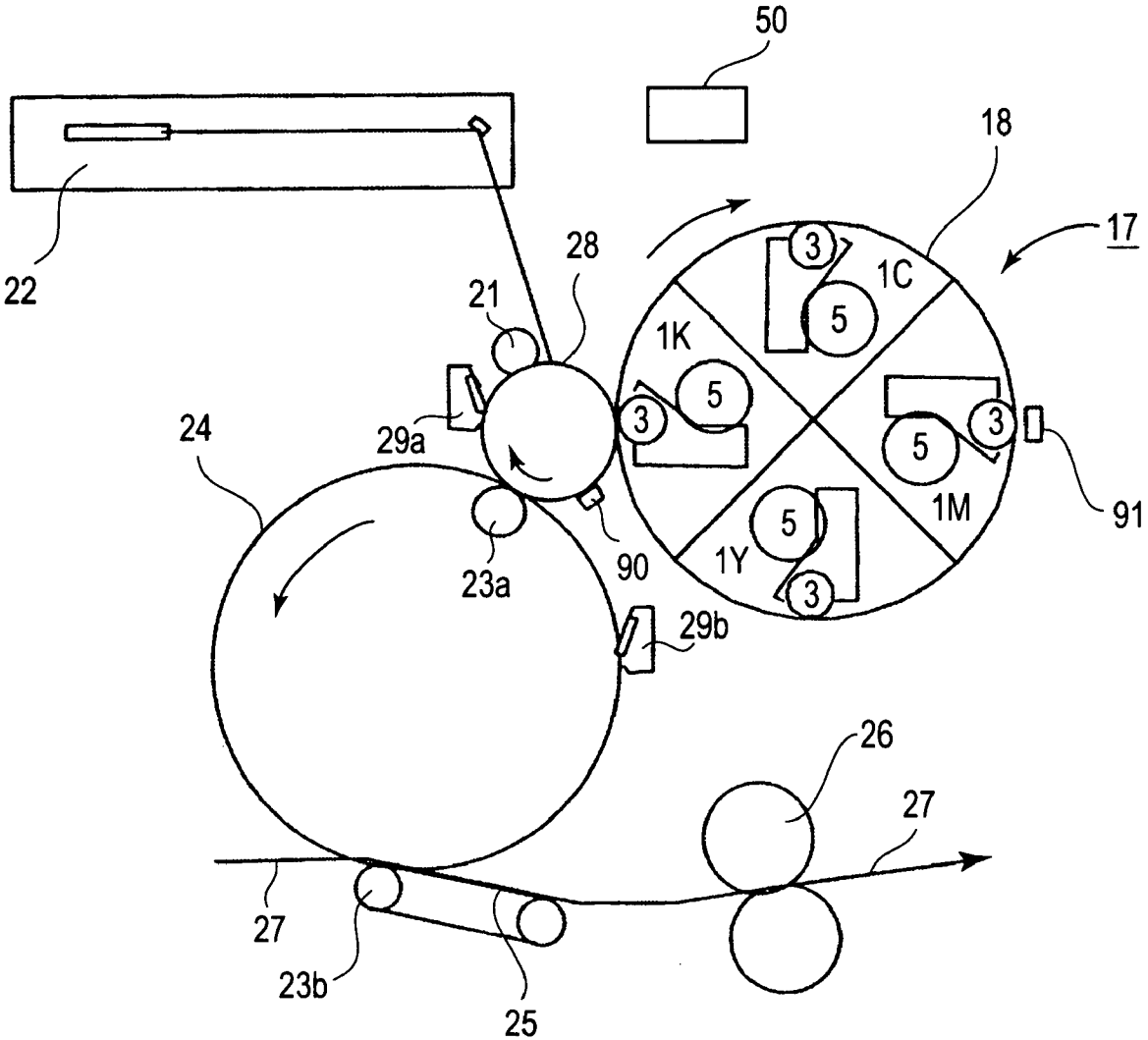
FIG. 1 is a schematic sectional view of the image forming apparatus in the first embodiment of the present invention, showing the general structure thereof.

FIG. 1 is a schematic sectional view of an image forming apparatus in this embodiment, showing the general structure thereof. First, the overall structure of the image forming apparatus will be described. The image forming apparatus in this embodiment is a color laser printer which uses an electrophotographic process, a rotary developing method, and an intermediary transfer system employing a transfer drum.

This image forming apparatus comprises: an electrophotographic photosensitive member (which hereinafter will be referred to as photosensitive drum) 28 as an image bearing member which is in the form of a rotatable drum and is rotationally driven at a predetermined peripheral velocity in the clockwise direction, or the direction indicated by an arrow mark; a primary charging device 21 for uniformly charging the peripheral surface of the photosensitive drum 28 to predetermined polarity and potential level; a laser based exposing apparatus 22 for forming an electrostatic latent image on the uniformly charged peripheral surface of the photosensitive drum 28, by exposing the uniformly charged peripheral surface of the photosensitive drum 28 to the beam of laser light it projects upon the peripheral surface in a manner to scan the peripheral surface; a rotary type development unit 17 for developing the electrostatic latent image on the peripheral surface of the photosensitive drum 28 into a visible image (toner image, or image formed of toner); an intermediary transfer drum 24 which is rotationally driven at a predetermined peripheral velocity in the clockwise direction, or the direction indicated by an arrow mark; a primary transfer charging device 23*a* for transferring the toner image from the peripheral surface of the photosensitive drum 28 onto the intermediary transfer drum 24; a secondary transfer charging device 23*b* for transferring the toner image from the intermediary transfer drum 24 onto a recording paper (transfer paper) 27; a fixing apparatus 26 for fixing the toner image on the recording paper 27 to the recording paper 27; etc.

Designated by a referential number 18 is the rotary of the development unit 17 of a rotary type. The rotary 18 holds the developing device 1K for developing an electrostatic latent image into a black toner image, developing device 1Y for developing an electrostatic latent image into a yellow toner image, developing device 1M for developing an electrostatic latent image into a magenta toner image, and developing device 1C for developing an electrostatic latent image into a cyan toner image, and is rotatable by an unshown motor. For development, the rotary 18 is rotated to move a specific developing device into the development position in which the development sleeve 3 of the specific developing device opposes the photosensitive drum 28, and then, it is kept stationary to keep the specific developing device in the development position. While the specific developing device is kept in the development position by the rotary 18, the developing device is mechanically and electrically controllable by an unshown controlling portion.

When forming a black toner image on the peripheral surface of the photosensitive drum 28, the rotary 28 is rotated to move the black color developing device 1K into the development position, in which the black developing device opposes the photosensitive drum 28 to develop the electrostatic latent image formed on the peripheral surface of the photosensitive drum 28. In order to form a yellow toner image on the peripheral surface of the photosensitive drum 28, the rotary 18 is rotated by 90° to move the yellow color developing device 1Y into the development position, in which the yellow developing device opposes the photosensitive drum 28 to develop the electrostatic latent image formed on the peripheral surface of the photosensitive drum 28. The rotation of the rotary 18 for the formation of the magenta and cyan toner images are the same as those described above.

At this time, the operation of this image forming apparatus in the full-color mode will be described. In the following description of the image forming apparatus, developing device 1 is a general term of the black color developing device 1K, yellow color developing device 1Y, magenta color developing device 1M, and cyan color developing device 1C. As the peripheral surface of the photosensitive drum 28 uniformly charged by the primary charging device 21 is exposed by the laser based exposing apparatus 22, an electrostatic latent image is formed on the peripheral surface of the photosensitive drum 28. This electrostatic latent image is developed into a toner image of a desired color, by the developing device 1 which contains a toner of the desired color. The toner image is transferred onto the intermediary transfer member 24 by the primary transfer bias provided by the primary transfer charging device 23*a*. When forming a full-color image, first, a black toner image is formed on the peripheral surface of the photosensitive drum 28 by the black color developing device 1K, and is transferred (primary transfer) onto the intermediary transfer member 24. Next, the rotary 18 is rotated by 90°, placing the yellow color developing device 1K in the development position, in which a yellow toner image is formed on the peripheral surface of the photosensitive drum 28. This yellow toner image is transferred (primary transfer) in layers onto the black toner image having been transferred onto the intermediary transfer member 24 in the preceding toner image forming process. These processes are sequentially carried out also by the magenta color developing device 1M and cyan color developing device 1C. As a result, an intended full-color toner image (layered combination of black, yellow, magenta, and cyan toner images) is formed on the intermediary transfer member 24. Thereafter, the full-color toner image, or layered four color toner images, are transferred (secondary transfer) all at once onto the recording paper 27 on the recording paper conveyance belt 25, by the secondary transfer bias provided by the secondary transfer charging device 23b. Then, the recording paper 27 is separated from the recording paper conveyance belt 25. Then, pressure and heat are applied to the recording paper 27 and the toner images thereon, by the fixing apparatus 26, yielding a permanent copy, or the recording paper 27 with a permanent full-color toner image. The toner which remains on the peripheral surface of the photosensitive drum 28 is removed by the primary cleaner 29*a*, whereas the toner remaining on the intermediary transfer member 24 after the secondary transfer 24 is removed by the secondary cleaner 29*b*, preparing thereby the image forming apparatus for the next image forming operation.

Figure 2:
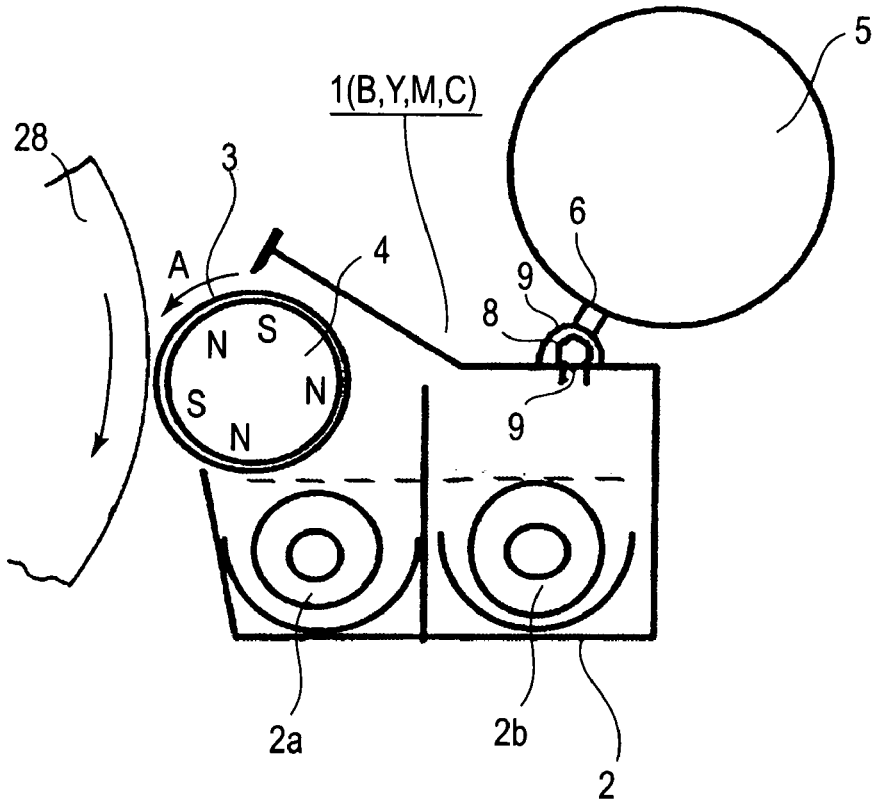
FIG. 2 is a schematic sectional view of one of the developing devices in the first embodiment of the present invention, showing the general structure thereof.

FIG. 2 is a schematic sectional view of the developing device 1 (K, Y, M, and C) mountable in the rotary 18 of the development unit 17 of a rotary type, showing the general structure thereof. The developing device 1 contains two-component developer, which is a mixture of nonmagnetic toner and magnetic carrier. The initial toner concentration (weight ratio of toner relative to overall weight of developer) is adjusted to 7%. This value of the toner concentration should be adjusted according to the charge capacity of toner, carrier particle diameter, structure of the image forming apparatus, and the like factors; in other words, the toner concentration of the developer does not need to be adjusted to this value.

The developing device 1 has an opening, which faces the photosensitive drum 28. The development sleeve 3 is rotatably supported by the housing of the developing device 1, being partially exposed through this opening of the developing device 1. the development sleeve 3 is formed of nonmagnetic substance, and contains in its center a stationary magnet 4 as a magnetic field generating means. During development, the development sleeve 3 is rotated in the direction indicated by an arrow mark A in FIG. 2. As the development sleeve 3 is rotated, a layer of the two-component developer in the housing 2 of the developing device 1 is borne on the peripheral surface of the development sleeve 3, and is conveyed to the development area, in which the peripheral surface of the development sleeve 3 opposes the peripheral surface of the photosensitive drum 28, developing thereby the electrostatic latent image on the peripheral surface of the photosensitive drum 28. The portion of the layer of the developer, which was not used for the development is returned to the housing 2 of the developing device 1 by the further rotation of the development sleeve 3. The developing device 1 also comprises a first stirring screw 2*a* (screw closer to development sleeve 3) and a second stirring screw 2*b* (screw farther from development sleeve 3), which are placed within the housing 2 of the developing device 1 to circulate the developer within the housing 2, and also, to mix the developer within the housing 2 with a fresh supply of toner supplied from a toner cartridge 5 as a toner storage.

The toner stored in the toner cartridge 5 is conveyed to the toner supply inlet 9 of the housing 2 of the developing device 1 through the toner supply outlet 6 of the toner cartridge 5, and is moved into the housing by a toner supply screw 8 as a toner supplying member as the toner supply screw 8 is rotated. The amount by which toner is moved into the housing 2 is roughly controlled by the length of time the toner supply screw 8 is rotated. Thus, a toner supply controlling means for controlling the length of time the toner supply screw 8 is rotated (which hereinafter will be referred to simply as rotation time of toner supply screw 8) will be described in more detail.

3) Toner Supply Controlling Means

With the repetition of the image forming operation, the toner concentration of the developer within the housing 2 of the developing device 1 reduces due to the toner consumption, making it necessary to supply the housing 2 with a proper amount of toner to keep the toner concentration of the developer in the housing 2 within a desired range. Basically, in this embodiment, one of the toner concentration detection methods based on a referential patch (which hereinafter will be referred to as patch detection method) is used to control the toner concentration. According to a patch detection method, each time an image forming operation is carried out, a patch, or a referential toner image, is formed on the peripheral surface of the photosensitive drum 28, and the density of this referential toner image is detected by a first optical sensor 90 (FIG. 1) as a density detection sensor. Then, the density signal from the optical sensor 90 is compared by an unshown control portion to the initial referential signal stored in advance. Then, based on the results of the comparison, the length of time the toner supplying portion is driven is controlled.

To describe the patch detection in more detail, the electrostatic latent image for forming the referential toner image of a predetermined size is formed on the peripheral surface of the photosensitive drum 28, and this electrostatic latent image is developed by the application of a predetermined development contrast voltage. Then, the density of the referential toner image is detected by the optical sensor 90 positioned to oppose the peripheral surface of the photosensitive drum 28. Then, the signal (density signal) Vsig outputted by the optical sensor 90 is compared to the initial referential signal Vref stored in advance in the memory of the unshown control section:

When $V\text{sig}-V\text{ref}<0$ the patch (toner image) is determined to be low in density, that is, the toner concentration is determined to be low. Then, the amount by which the toner is to be supplied, and the corresponding length of time the toner supply screw 8 is to be rotated, are determined based on the difference between the Vref and Vsig.

On the other hand, when $V\text{sig}-V\text{ref}=0$, it is determined that the patch (toner image) is high in density, that is, the toner concentration is high. In other words, it is determined that the housing 2 does not need to be supplied with toner. Therefore, the toner supply screw 8 is kept stationary.

However, controlling the toner concentration with the use of a patch detection method alone as described above is problematic in that it is possible that the toner concentration will not be properly controlled, because of the changes in various factors involved in the development process. For example, if a body of developer in the initial condition (fresh supply of developer) is used to continuously form a substantial number of images, the developer gradually increases in triboelectric charge, reducing thereby the patch (referential toner image) in density. Thus, a patch detection method erroneously determines that the toner concentration is too low, and the control is executed in the direction to increase the toner concentration. As a result, the toner concentration in the housing 2 is moved out of the proper range, sometimes resulting in the formation of foggy images, or scattering of developer.

Thus, in this embodiment, a second optical sensor 91 (FIG. 1) as an image density sensor is placed at a location, which is outside the developing device 1 of the development unit 17 of a rotary type, and in the adjacencies of the rotary 18, in order to solve the above described problem by detecting the toner concentration within the developing device by this sensor 91.

Figure 3:
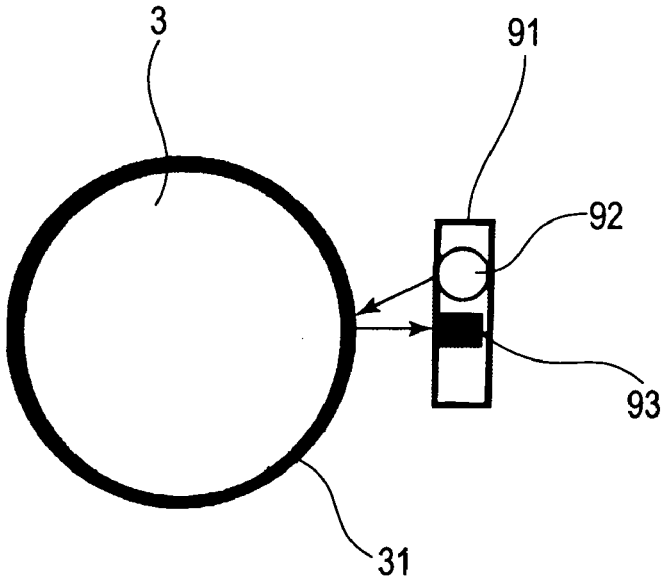
FIG. 3 is a schematic sectional view of the optical sensor in the first embodiment of the present invention, showing the general structure thereof.
Figure 4:
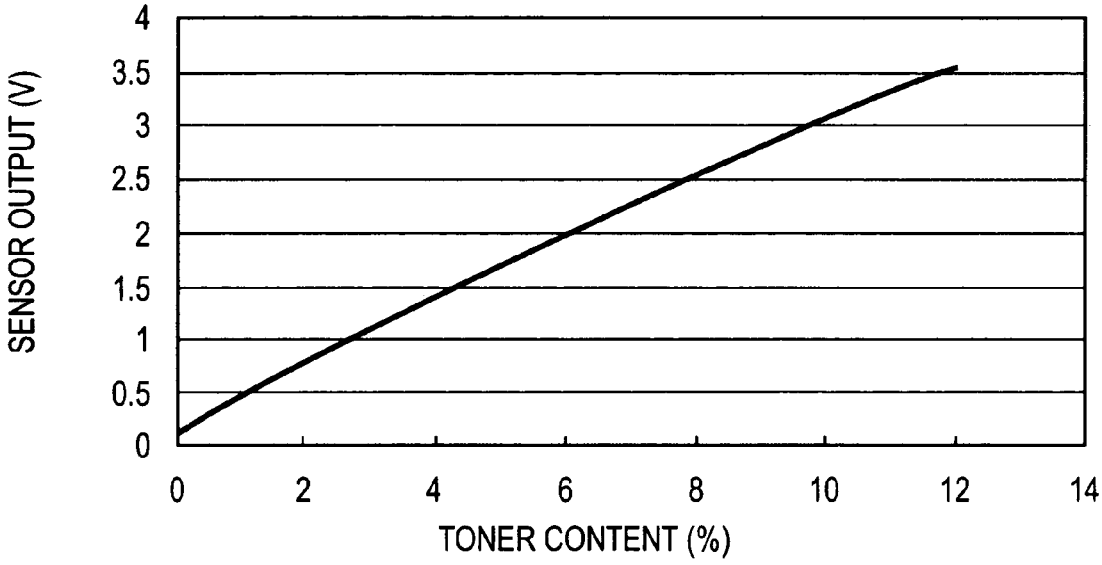
FIG. 4 is a graph showing the correlation between the actual toner concentration of developer and the output value of the optical sensor.

Referring to FIG. 3, the optical sensor 91 has an LED 92 as a light emitting element, and a photodiode as a light receiving element. The light emitted toward the developer 31 on the development sleeve 3 from the LED is diffused by the developer, and a part of the diffused light enters the photodiode 93. The output value of the sensor, which corresponds to the amount of the light diffused by the developer 31, is proportional to the toner concentration as shown in FIG. 4; the higher the toner concentration the higher the output value. However, the black toner absorbs light. In other words, the black toner does not diffuse the light, making it difficult to detect the concentration of the black toner. In this embodiment, therefore, the toner concentration is controlled based on the detected values of only the toner concentrations of the yellow, magenta, and cyan developers.

Next, the toner concentration detection method in this embodiment will be described in more detail.

In this embodiment, a controlling means 50 is provided with a counter for counting the number of the images formed by the image forming apparatus. Each time an image of small size is formed, the counter value is increased by 1, whereas each time an image of large size is formed, the counter value is increased by 2. As the cumulative value N of the counter reaches 50, the toner concentration detection operation is carried out when forming the next image. In this embodiment, the optical sensor 91 is positioned, as shown in FIG. 1, so that while the developing device 1 for a given color is in the position in which it opposes the photosensitive drum 28 to develop the latent image on the photosensitive drum 28, the toner concentration of another developing device 1 can be detected. Positioning the optical sensor 91 as described above makes it unnecessary to use time for toner concentration detection, eliminating therefore downtime in terms of image formation efficiency.

More specifically, as the black color developing device 1K is moved into the development position in which it opposes the photosensitive drum 28 to develop the latent image on the photosensitive drum 28, the magenta color developing device 1M is moved into the position in which it opposes the optical sensor 91, so that the light reflected by the peripheral surface of the development sleeve 3 of the magenta color developing device 1M is detected by the optical sensor 91 which outputs the density signal Vdec, the value of which corresponds to the amount of the light reflected by the peripheral surface of the development sleeve 3. The density signal Vdec outputted by the optical sensor 91 is used, in conjunction with the referential signal Vint, which corresponds to the initial toner concentration (7% in this embodiment) stored in advance in the memory of the control section, and the toner concentration sensitivity Vrate, by the unshown control section, to calculate the toner concentration TD.

$$TD(\%)=(V\text{dec}-V\text{int})/V\text{rate}+7 \quad (1)$$

When the value of TD obtained from the above equation is no less than 4% and no more than 10%, it is determined that the toner concentration within the developing device is within the proper range, and the toner supply control based on the patch detection method is continued.

On the contrary, when the value of TD is no more than 4% and no less than 10%, it is determined that the toner concentration is out of the proper range. Thus, an adjustment is made to the above-described patch detection based toner supply control, in order to put the toner concentration back into the proper range. More specifically, if the value of TD exceeds 10%, an adjustment is made to lower the value of the initial referential signal Vref for the patch detection method, in order to reduce the amount by which toner is supplied. For example, the value of the initial referential signal Vref is reduced by 45 levels, establishing a new referential signal level Vref-adj, and thereafter, the toner supply is controlled with reference to this new Vref-adj.

$$V\text{ref-adj}=V\text{ref}-45 \quad (2)$$

Then, control is executed so that only when Vig−Vref−adj<0, the housing 2 is supplied with toner, reducing thereby the amount of the toner in the housing 2. As a result, the toner concentration is reduced.

On the other hand, when the value of TD is no more than 4%, a new referential signal Vref−adj is established, which is 45 levels higher than the initial referential signal Vref, and thereafter, the toner supply is controlled with reference to this hew Vref−adj.

$$V\text{ref-adj}=V\text{ref}+45 \quad (3)$$

Then, control is executed so that when Vsig−Vref−adj<0, toner is supplied, increasing thereby the amount of the toner in the housing 2. As a result, the toner concentration is increased.

When the value of TD obtained after the above described adjustments is no more than 4% or no less than 10%, the new referential signal Vref−adj established by the adjustment is kept. However, if it is no less than 4% and no more than 10%, the new referential signal Vref−adj is discarded, and the referential value for the patch detection method is restored to the initial one, or Vref. The counter is reset to 0 each time the toner concentration is detected.

Incidentally, in this embodiment, Equations (2) and (3) are used for calculating the values to be used for adjusting the referential value for the patch detection method. However, these values are to be set according to the properties of the developer used by the apparatus, structure of the developing device, and/or the like factors. In other words, they do not need to be limited to the abovementioned values.

Figure 5:
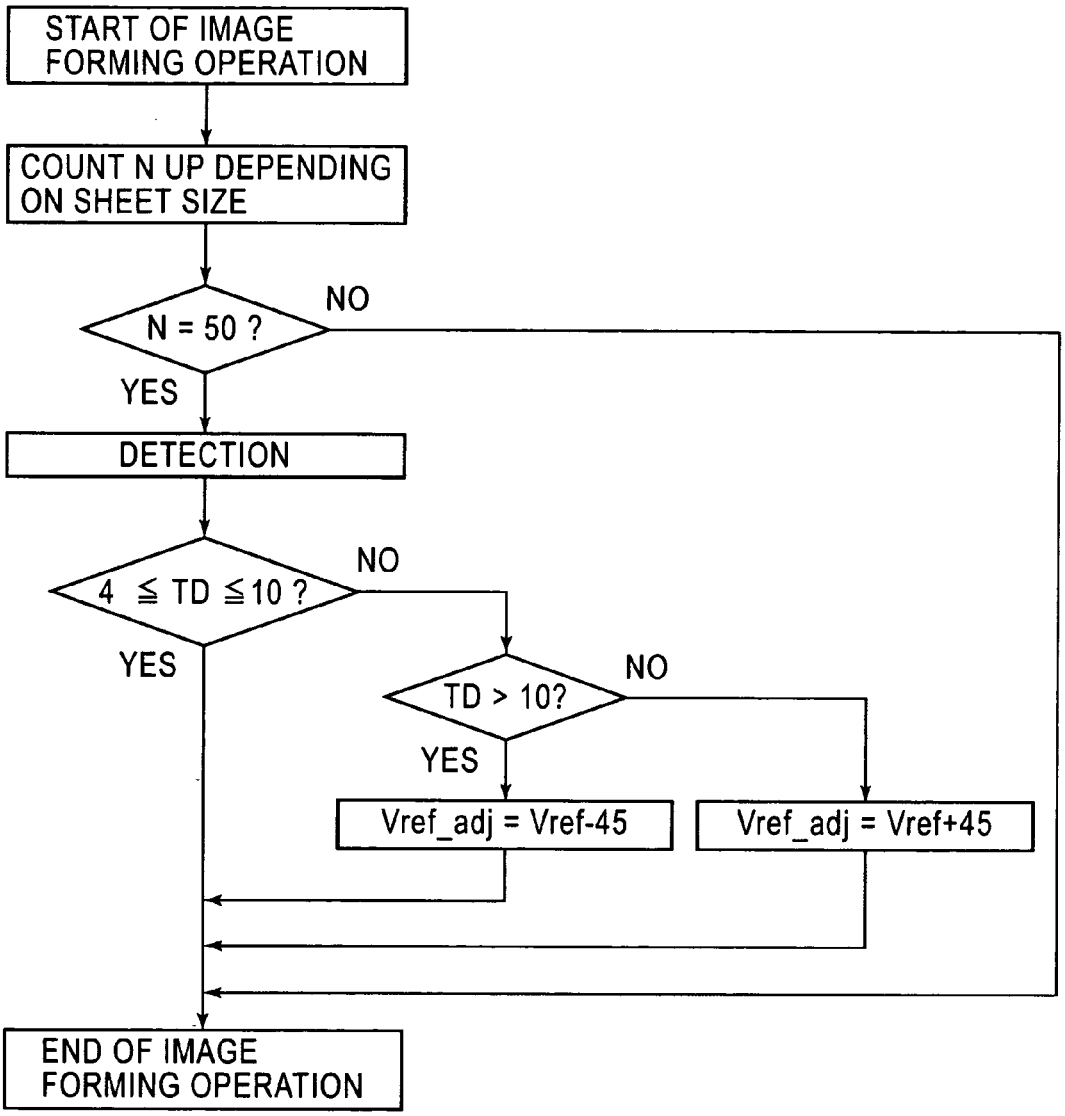
FIG. 5 is a flowchart for adjusting the referential values for a toner concentration detecting method of a patch type, based on the results of toner concentration detection.

By controlling the toner supply as described above, it is possible to eliminate the possibility that when the toner supply is controlled by a patch detection method, the toner concentration will move out of the proper range. FIG. 5 is the flowchart for the above described compensation process.

Figure 6:
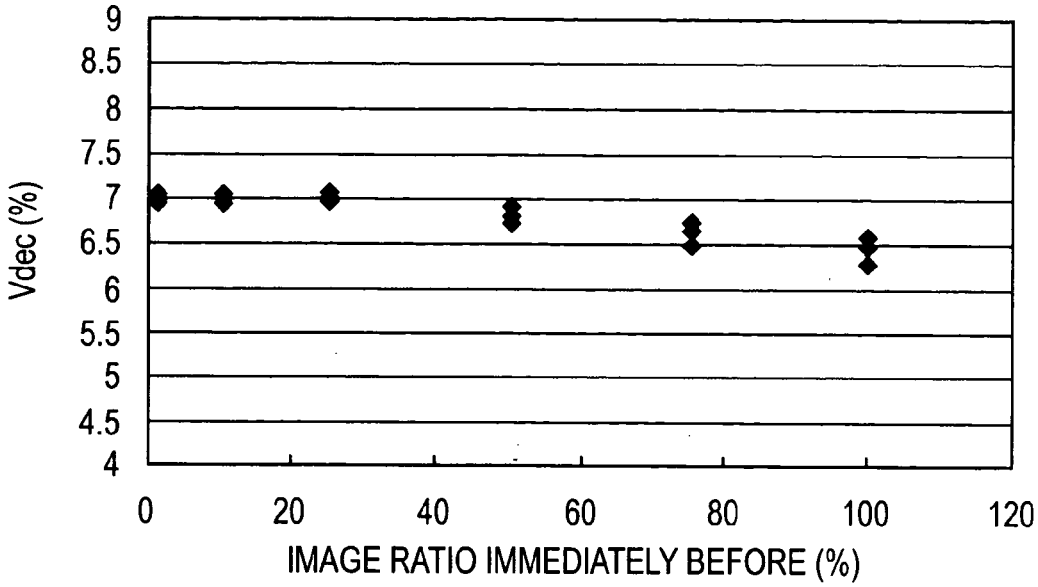
FIG. 6 is a graph showing the correlation between the image ratio of an image formed immediately before the toner concentration detection, and the toner concentration (Vdec) detected using the structural arrangement in accordance with the prior art.

In the case the patch detection method in accordance with the prior art, in which the toner concentration in the developing device 1 is calculated from the amount of the light reflected by the developer layer on the peripheral surface of the development sleeve 3 of the developing device 1, detected with predetermined timing, as it is in this embodiment, the image ratio of the image formed immediately before the toner concentration is detected affects the detection, causing the toner concentration to be erroneously detected. For example, the image ratio of the image formed immediately before the toner concentration detection is no less than 50%, the detected concentration is lower than the actual value; even when the actual toner concentration in the developing device was 7%, the detected toner concentration was lower than 7%, as shown in FIG. 6. The higher the image ratio, the more conspicuous is this phenomenon, because, as an image with a high image ratio is formed, the toner in the developer layer on the development sleeve 3 is consumed by a large amount in a short length of time, making the toner concentration of the developer layer on the development sleeve 3 substantially lower than that of the developer in the housing 2 of the developing device 1. Further, as the toner in the developer layer on the development sleeve 3 is consumed by a large amount in a short length of time, the developer layer on the development sleeve 3 is likely to become nonuniform in toner concentration. This is why there is the tendency that the higher the image ratio of the image formed immediately before toner concentration detection, the greater the errors in the results of the toner concentration detection, as shown in FIG. 6.

Another factor that makes it difficult to accurately detect the toner concentration (reason why there is a difference between the detected toner concentration and the actual toner concentration) is the image formation mode in which the image forming operation is carried out immediately before the toner concentration detection. In the case of such a development unit of a rotary type as the development unit 17 in this embodiment, when the image forming apparatus is in the monochromatic mode, only the developing device 1 for developing the selected color is moved into the position in which the developing device 1 opposes the photosensitive drum 28, and images are continuously formed with the use of only this developing device 1. Therefore, the development sleeves in the other developing devices 1 are not rotated at all, and as the monochromatic image forming operation ends, the rotary 18 is rotated back into the home position in which the rotary 18 is kept until the next image forming operation, and in which it keeps all the developing devices 1 out of the position in which they oppose the photosensitive drum 28. In this embodiment, the home position of the rotary 18 is set to be such that the black color developing device 1K is kept at 28° upstream of the development position, or the position in which it opposes the photosensitive drum 28, in terms of the rotational direction of the rotary 18.

This movement of the rotary 18 into the home position is mandatory after the completion of each image forming operation. Therefore, when a monochromatic image forming operation of a specific color is repeated, the development sleeves in the developing devices other than the one used for the operation are not rotated at all, and yet, are moved past the development position, in which they oppose the photosensitive drum 28, as the rotary 18 is moved back into the home position at the end of each monochromatic operation. Thus, as the development sleeves in the developing devices other than the one used for the operation are moved through the development position in which they oppose the photosensitive drum 28, the toners on the development sleeves transfer onto the photosensitive drum 28 although only by a small amount. Therefore, with the repetition of the monochromatic image forming operation, the toners on the development sleeves of the developing devices other than the one used for the monochromatic operation gradually reduce. Therefore, if these development sleeves are subjected to the toner concentration detection operation immediately after the completion of the repetition of the monochromatic operation, the detected toner concentrations are lower than the actual ones. The results of one of such erroneous toner concentration detections as the one described above is shown in FIG. 7, in which the relationship between the toner concentration of the cyan color developing device detected immediately after the repetition of the monochromatic image forming operation in black color, and the number of times the monochromatic image forming operation was repeated, is shown.

In this embodiment, therefore, in order to prevent the above described phenomenon to assure that the toner concentration is accurately detected, the development sleeves are idly rotated for a predetermined length of time immediately before the toner concentration detection.

If an image forming operation to be carried out immediately after the cumulative number of copies counted by the counter for counting the number of copies made by the image forming apparatus reached 50 is in the full-color mode, each development sleeve is idly rotated for five seconds after the completion of the development process. Then, the rotary 18 is rotated to place the next developing device into the development position. During the idling of the development sleeve, the same DC voltage as the DC voltage applied as the development bias during the development is applied. In this context, when not detecting the toner concentration, the development device switch is done immediately after the completion of the development. As described above, in this embodiment, each developing device is moved into the toner concentration detection position by the development device switch, after it is idly rotated for the predetermined length of time.

Figure 8:
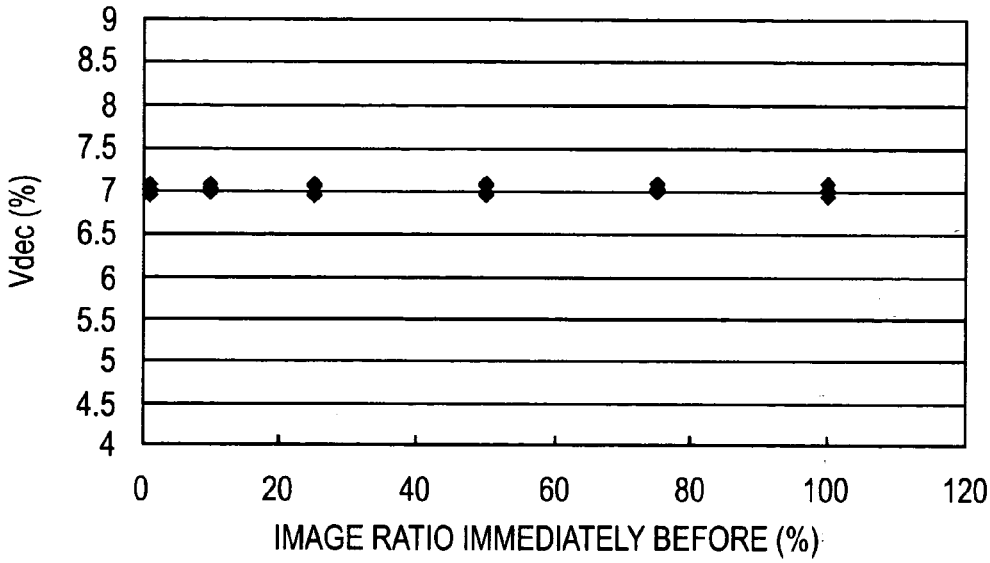
FIG. 8 is a graph showing the correlation between the image ratio of an image formed by an image forming apparatus structured in accordance with the present invention, immediately before the toner concentration detection, and the detected toner concentration (Vdec).

The developer on the peripheral surface of the development sleeve 3 after the five seconds of idle rotation of the development sleeve 3 is such developer that has been borne on the peripheral surface of the development sleeve 3 after being fully stirred in the developing device. In other words, it is such developer from which the effects of the previously formed images have been completely erased. Therefore, even if the image ratio of the image formed immediately before the toner concentration is detected is high, the errors in the toner concentration detection are very small as shown in FIG. 8.

Figure 9:
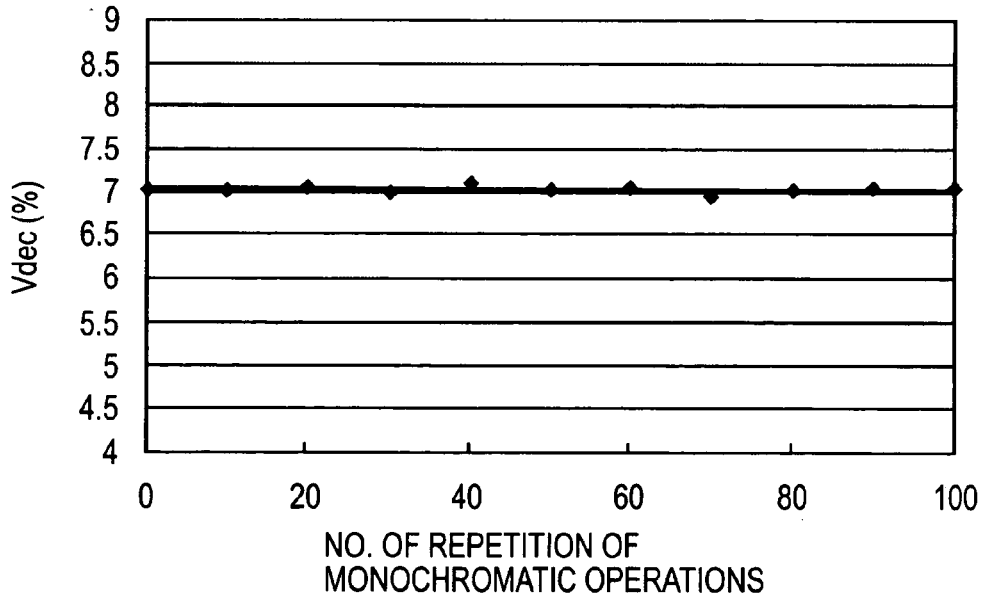
FIG. 9 is a graph showing the correlation between the number of times the monochromatic image forming operation is repeated by an image forming apparatus, structured in accordance with the present invention, immediately before the toner concentration detection, and the detected toner concentration (Vdec).

In comparison, if an image forming operation to be carried out immediately after the cumulative number of copies counted by the counter for counting the number of copies made by the image forming apparatus reached 50 is in the monochromatic mode, the development sleeve, which is being used for the monochromatic image forming operation is idly rotated for five seconds in the development position, in which the development sleeve opposes the photosensitive drum 28, while the sleeve 3 is moved past the development position by the rotation of the rotary 18 for returning the rotary 18 to the home position. In other words, if the cumulative value in the counter has reached 50, and the mode in which an image forming operation is carried out immediately before the toner concentration is to be carried out is the monochromatic mode, the development sleeve, which is being used for the monochromatic operation, is rotated as described above before the toner concentration of the developer thereon is detected. Then, after the toner concentrations of the developers on the development sleeves of all the developing devices are detected, the rotary 18 is finally moved back into the home position. With the employment of the above described procedure, it was possible to make the errors in the toner concentration detection extremely small, regardless of the mode in which the image forming operation was carried out immediately before the toner concentration detection (FIG. 9).

Incidentally, in this embodiment, the toner concentration calculated from the detected amount of the light reflected by the developer layer on the peripheral surface of the development sleeve 3 is used to adjust the referential value for the patch detection. However, the toner supply may be controlled based directly on this detected amount of the reflected light.

As described above, according to this embodiment, the image forming apparatus in which the toner concentration in the developing device is calculated from the amount of the light reflected by the layer of developer on the peripheral surface of the development sleeve 3, which is detected by the optical sensor 92 located outside the developing device, and the toner concentration is controlled based on the value obtained by the calculation, is controlled in the above described manner. Therefore, the toner concentration can be reliably detected, regardless of the conditions and/or modes under which an image forming operation is carried out immediately before the toner concentration is detected. Therefore, it is possible to provide an image forming apparatus which remains reliable for a substantially longer period of time than an image forming apparatus in accordance with the prior art.

[Embodiment 2]

The structure of the image forming apparatus in this embodiment is the same as that of the image forming apparatus in the first embodiment, except for the following feature which characterizes this embodiment. That is, in this embodiment, when detecting the amount of the light reflected by the developer layer on the peripheral surface of the development sleeve with the use of a density sensor, the first and second stirring screws 2*a* and 2*b* as developer supplying means for supplying the development sleeve 3 with the developer stored in the developing device 2, are rotated along with the development sleeve 3, for a predetermined length of time, under the condition in which toner cannot be adhered to the photosensitive drum 28. In other words, in this embodiment, before detecting the amount of the light reflected by the developer layer on the peripheral surface of the development sleeve 3, the photosensitive drum 28 is rotated no less than one full turn while being cleared of electric charge. Then, the development sleeve 3, and first and second stirring screws 2*a* and 2*b* are idly rotated for a predetermined length of time. During these rotations, the development bias is not applied to the development sleeve 3.

When detecting the toner concentration in the developing device for a given color while another developing device is being used for development, it is desired, in order to prevent the carrier adherence, and also, minimize the length of the downtime, that the development sleeve is idly rotated while applying development bias and leaving the photosensitive drum 28 charged, as in the first embodiment. With the above described structure, there is a difference in potential level between the photosensitive drum 28 and development sleeve 3, causing sometimes the so-called fog, that is, the phenomenon that the toner on the development sleeve 3 transfers by a small amount onto the photosensitive drum 28, to occur depending on the developer condition. The amount of the fog is affected by the developer condition which is affected by the ambience, cumulative number of the images developed by the developer, toner concentration of the developer, etc. Therefore, there is the possibility that the toner concentration of the developer will be erroneously detected, although very slightly.

In this embodiment, therefore, in order to eliminate this problem, before idly rotating the development sleeve before detecting the toner concentration, the photosensitive drum 28 is rotated no less than one full turn while cleaning the photosensitive drum 28 of electric charge, and not applying the development bias. As a result, the difference in potential level between the photosensitive drum 28 and development sleeve 3 is eliminated, making it possible to further reduce the errors in the toner concentration detection.

[Embodiment 3]

Figure 10:
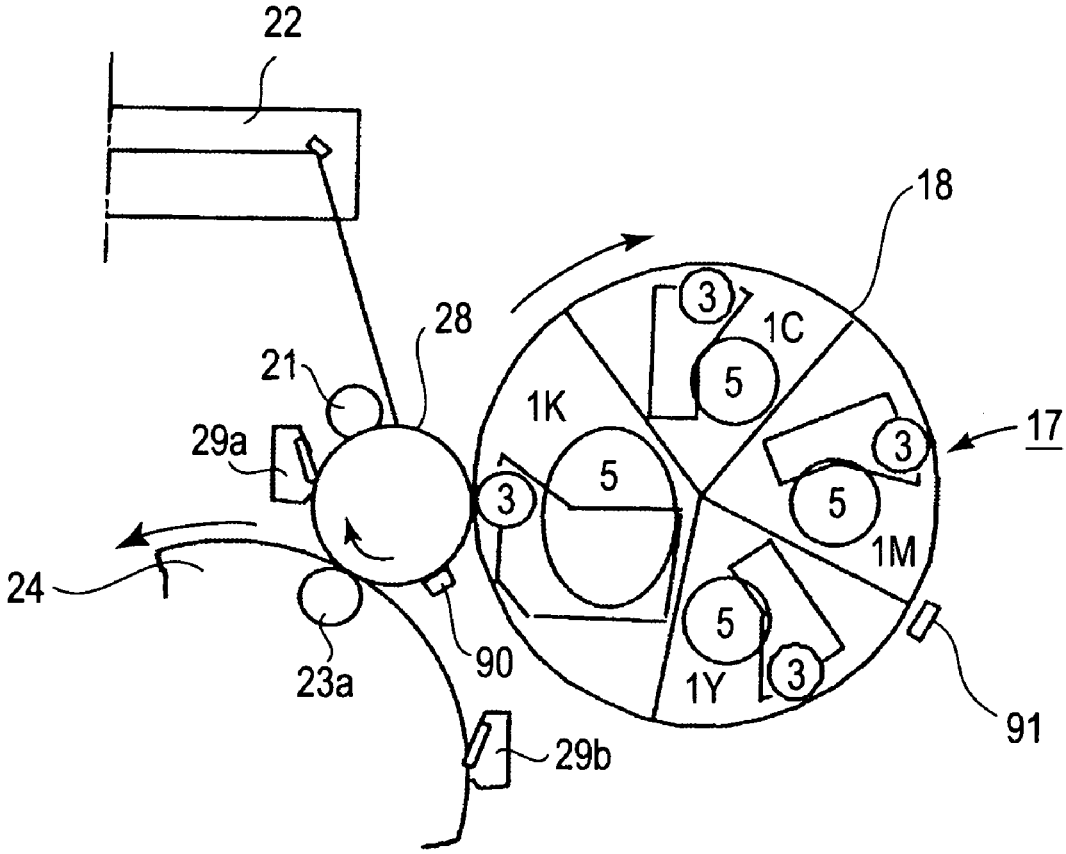
FIG. 10 is a schematic sectional view (No. 1) of the portions of the image forming apparatus in the third embodiment of the present invention, directly related to the present invention.

The structure of the image forming apparatus in this embodiment is shown in FIG. 10. The image forming apparatus in this embodiment is characterized in that the toner cartridge 5 of the black color developing device 1K among the plurality of the developing devices thereof is larger than the toner cartridges 5 for the other developing devices.

Generally, the number of the monochromatic images formed by an ordinary user of an image forming apparatus, or the number of the monochromatic originals copied by the ordinary user, is substantially greater than the number of full-color images formed by the ordinary user, or the full-color originals copied by the ordinary user. Therefore, the amount by which the black toner is consumed is likely to be greater than the amounts by which the toners of the other colors are consumed. Thus, if all the toner cartridges 5 are made equal in size, the frequency with which the black toner cartridge must be replaced is higher than the frequency with which the other toner cartridges are replaced; the user is more frequently required to perform the toner cartridge replacement procedure. Further, frequently replacing a toner cartridge is disadvantageous from the standpoint of operational cost.

All that is necessary to solve the above described problem is to make the black toner cartridge larger than the cartridges for the other colors, in order to increase the black toner cartridge in toner capacity. However, this solution increases the overall size of the black color developing device 1*k*. Therefore, if the rotary 18 is such a rotary that the four toner cartridge compartments thereof are equal in size, the black toner cartridge is too large for the toner cartridge compartments.

In this embodiment, therefore, the toner cartridge holding space of the rotary 18 is unequally divided as shown in FIG. 10 to provide a toner cartridge compartment capable of accommodating the black color developing device 1K. Such a structural arrangement, however, makes the position in which a given developing device is to be placed for toner concentration detection different from the positions in which another developing device is placed for toner concentration detection. Therefore, it is impossible to detect the toner concentration of a given developing device while another developing device is used for the development as in the first embodiment.

Therefore, the image forming apparatus in this embodiment is provided with a toner concentration detection mode dedicated for detecting the amount of the light reflected by the developer layer on the peripheral surface of the development sleeve 3, in addition to the ordinary image formation modes, and the toner concentration is detected in this dedicated toner concentration detection mode.

Figure 11:
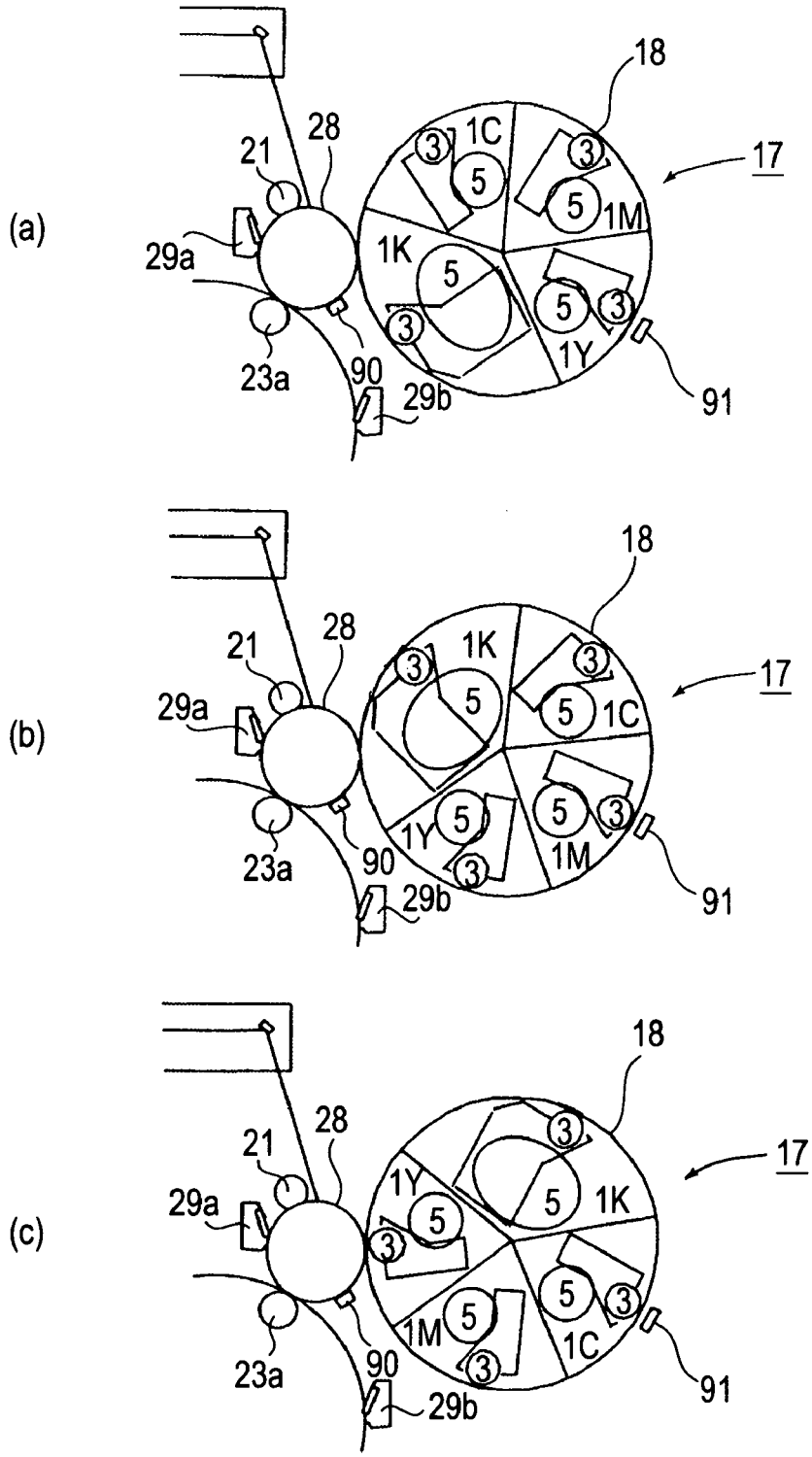
FIG. 11 is a schematic sectional view (No. 2) of the portions of the image forming apparatus in the third embodiment of the present invention, directly related to the present invention.
Figure 6:
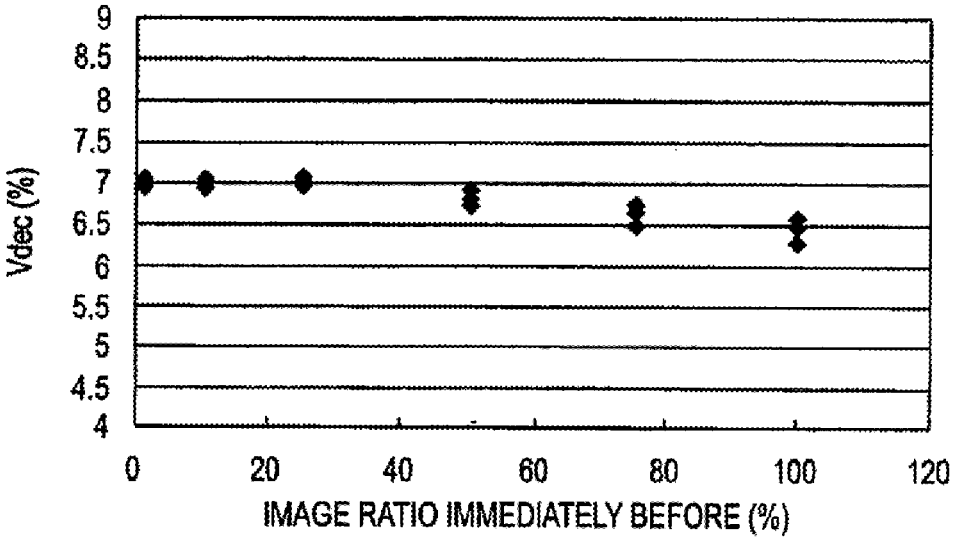
Figure 7:
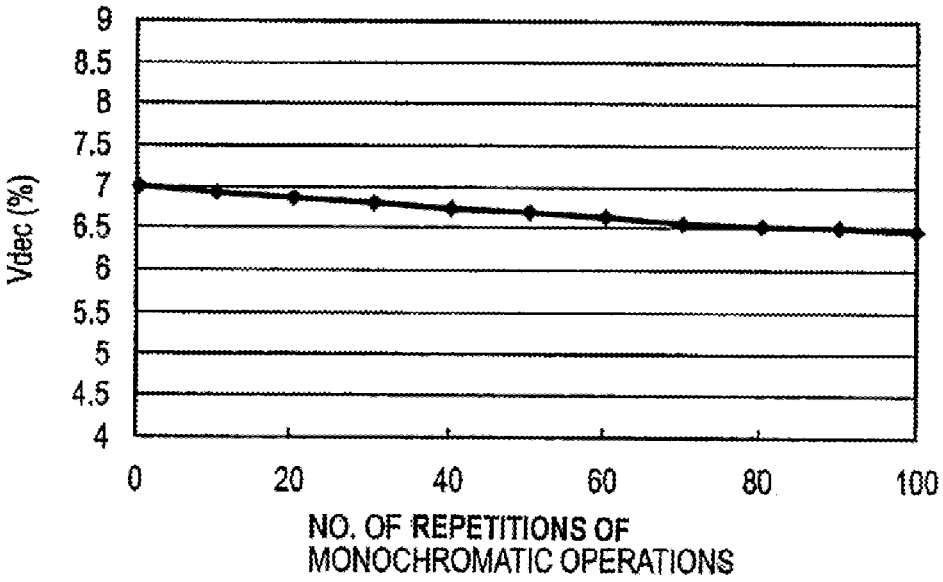
Figure 8:
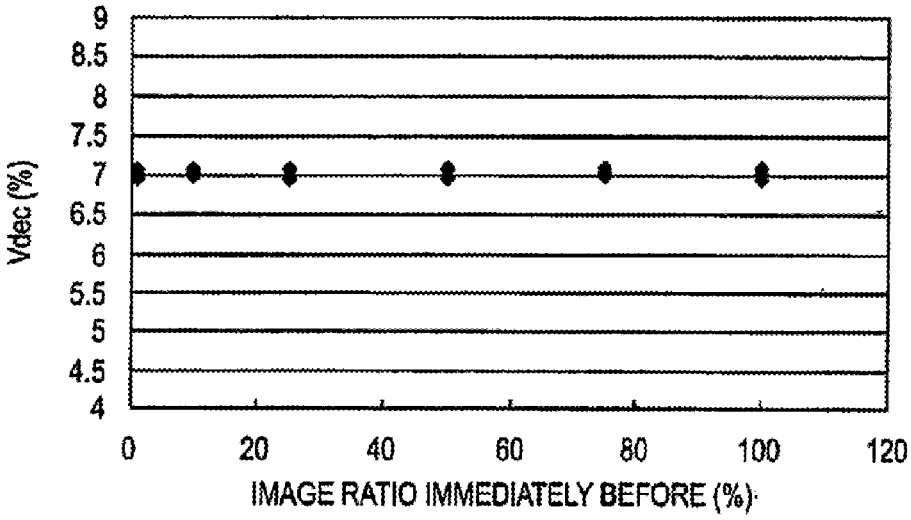
Figure 9:
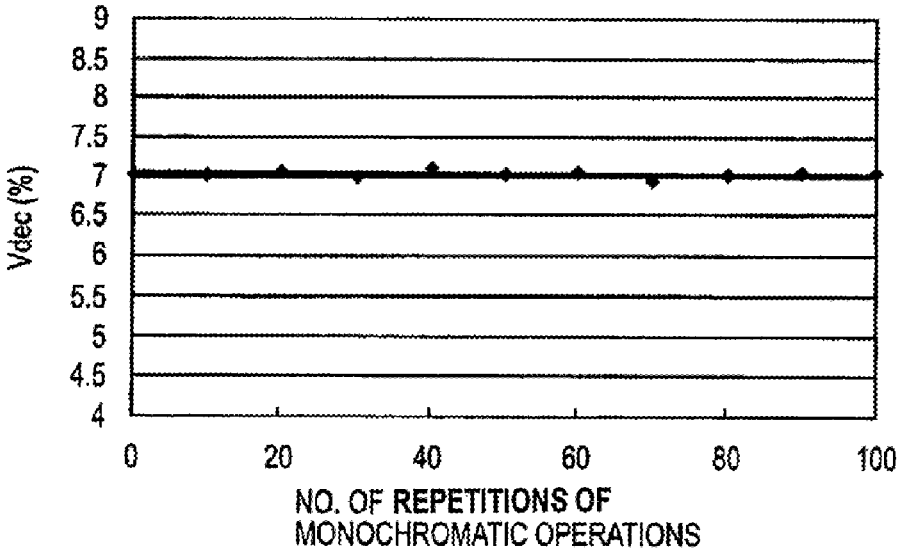

More specifically, as the cumulative value N of the copy counter reaches 50 during a given image forming operation, the abovementioned dedicated toner concentration detection mode is carried out during the post-rotation period (period in which the main motor is continuously driven to cause the pertinent processing devices to perform their post-print job operations, after the completion of the job. After the completion of the predetermined post-rotation processes, the driving of the main motor is stopped, and the image forming apparatus is kept on standby until the start signal for the next pint job is inputted) of the current job. In the dedicated toner concentration detection mode, first, the photosensitive drum is rotated no less than one full turn while being cleared of electric charge, and then, the yellow color developing device 1Y is moved into the development position in which it opposes the photosensitive drum 28. In this development position, the development sleeve is idly rotated for five seconds with the development bias turned off. Then, the magenta color developing device 1M is moved into the development position in which it opposes the photosensitive drum 28, and in which the development sleeve is idly rotated for five seconds. Similarly, the development sleeve of the cyan color developing device is idly rotated for five seconds. After the development rollers of the yellow, magenta, and cyan developing devices 1Y, 1M, and 1C are idly rotated for five seconds, the developing devices 1Y, 1M, and 1C are sequentially moved into the position in which they oppose the optical sensor 91, as shown in FIGS. 11(*a*)–11(*c*), respectively, and in which the amount of the light reflected by the developer layer on the development sleeve of each developing device is detected. Eventually, the rotary 18 is rotated into the home position, and is kept therein on standby. Then, based on the toner concentration calculated from the detected amount of the light reflected by the developer layer, the referential value of the patch detection method is adjusted, or the toner supplying process is controlled.

As described above, according to this embodiment, the mode dedicated to the detection of the amount of the light reflected by the developer layer on the peripheral surface of the development sleeve is provided in addition to the ordinary image formation modes, and in this mode dedicated to the toner concentration detection, the toner concentration is detected after the development sleeve is idly rotated. Therefore, the toner concentration can be reliably detected even in the case of the image forming apparatus employing the rotary 18, the internal space of which is divided into a plurality of developing device compartments unequal in size.

[Miscellany]

1) The structural arrangement for moving the plurality of developing devices in order to switch the developing device in the development position with another developing device is optional; it does not need to be limited to the rotary 18 in the preceding embodiments. For example, the structural arrangement may be such that the plurality of developing devices are stacked in parallel in a member movable in the vertical or horizontal direction so that the developing device in the development position can be switched with another developing device by vertically or horizontally moving the movable member.

2) The principle, or process, for the formation of an image on an image bearing member, does not need to be limited to the electrophotographic process in the preceding embodiments, which employs the intermediary transfer member. For example, the present invention is also compatible with a transfer or direct image formation process. Further, the present invention is compatible with an electrostatic recording process, a magnetic recording process, and the like.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 330031/2003 filed Sep. 22, 2003, which is hereby incorporated by reference.

What is claimed is:

1. An image forming apparatus comprising:

an image bearing member for bearing an electrostatic image;

developing means for developing the electrostatic image on said image bearing member with a developer including toner at a developing position, said developing means including:

a plurality of developing devices containing toners which have colors different from each other, said developing devices each having a developer carrying member for carrying the developer, and moving means for carrying said developing devices to move a selected one of said developing devices to the developing position;

density detecting means for detecting a toner density on said developer carrying member of any said developing devices located at a position different from the developing position;

toner replenishment control means, responsive to an output of said density detecting means, for controlling toner replenishment to said developing devices, and control means for controlling said detecting means to detect the toner density after executing a non-image forming rotation of said developer carrying member for a predetermined time period, in the case that said detecting means is to detect the toner density on said developer carrying member having passed through said developing position without rotation relative to said developing device during movement of said moving means.

2. An apparatus according to claim 1, wherein said control means moves one of said developing devices for which the density detecting operation is effected to the developing position, and rotates said developer carrying member at the developing position, and then moves said one of the developing devices to the detecting position, and then effects the density detecting operation.

3. An apparatus according to claim 1, wherein each of said developing devices includes supply means for supplying the developer to said developer carrying member, and wherein said control means actuates said supply means when said image bearing member is rotated through the predetermined period of time.

4. An apparatus according to claim 2, wherein said control means prevents a transfer of a toner from said developer carrying member to said image bearing member when said developer carrying member is rotated through the predetermined period of time.

5. An apparatus according to claim 4, wherein the prevention of the transfer of the toner is effected by a developing bias not being applied to a developer carrying member with said image bearing member having been electrically discharged.

* * * * *

UNITED STATES PATENT AND TRADEMARK OFFICE

CERTIFICATE OF CORRECTION

PATENT NO. : 7,027,746 B2
APPLICATION NO. : 10/944777
DATED : April 11, 2006
INVENTOR(S) : Hideaki Suzuki et al.

It is certified that error appears in the above-identified patent and that said Letters Patent is hereby corrected as shown below:

ON THE COVER PAGE:

UNDER REFERENCES CITED, ITEM (56):

"JP 2001034019 A * 2/2001" should read --2001-034019 A * 2/2001--; and
"JP 2001066844 A * 3/2001" should read --JP 2001-066844 A * 3/2001--.

IN THE ABSTRACT, ITEM (57):

Line 13, "member" should read --member of--; and
Line 16, "operation" should read --operation is--.

Figure 7:
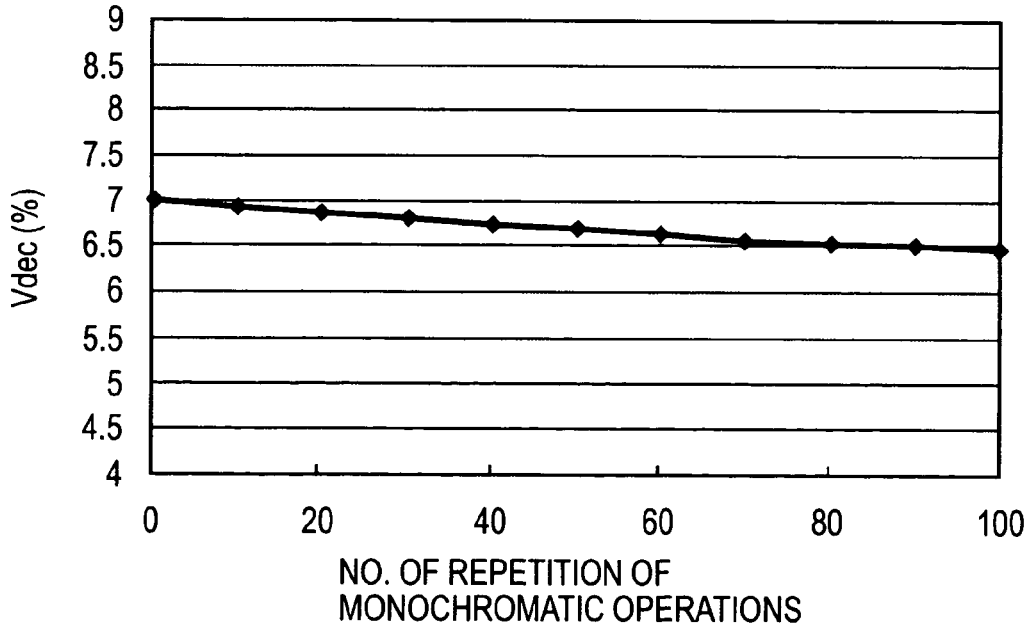
FIG. 7 is a graph showing the correlation between the number of times the monochromatic image forming operation is repeated by an image forming apparatus, structured in accordance with the prior art, immediately before the toner concentration detection, and the detected toner concentration (Vdec).

IN THE DRAWINGS:

In Sheet 5, Figure 7, "REPETITION" should read --REPETITIONS--; and
In Sheet 6, Figure 9, "REPETITION" should read --REPETITIONS--.
SEE ATTACHED SHEETS

COLUMN 3:

Line 57, "slected" should read --selected--; and
Line 61, "of a developing" should read --of one of said developing--; and "position in" should read --position--.

COLUMN 4:

Line 4, "a" should be deleted.

COLUMN 5:

Line 56, "rotary 28" should read --rotary 18--.

COLUMN 6:

Line 52, "operation." should read --operation. 2) Development Unit 17 and Developing Device 1 (K, Y, M, and C)--.

UNITED STATES PATENT AND TRADEMARK OFFICE

CERTIFICATE OF CORRECTION

PATENT NO. : 7,027,746 B2
APPLICATION NO. : 10/944777
DATED : April 11, 2006
INVENTOR(S) : Hideaki Suzuki et al.

It is certified that error appears in the above-identified patent and that said Letters Patent is hereby corrected as shown below:

COLUMN 7:

Line 3, "1. the" should read --1. The--.

COLUMN 9:

Line 58, "hew" should read --new--.

COLUMN 10:

Line 19, "case" should read --case of--; and
Line 28, "example," should read --example, when--.

Signed and Sealed this

Fourteenth Day of November, 2006

JON W. DUDAS
*Director of the United States Patent and Trademark Office*